US005591038A

United States Patent [19]

Guzay, Jr. et al.

[11] Patent Number: 5,591,038

[45] Date of Patent: Jan. 7, 1997

[54] PLUG LOCKOUT

[75] Inventors: Casimir M. Guzay, Jr., Hoffman Estates; Shawn E. Whittaker, Lockport, both of Ill.

[73] Assignee: Panduit Corp., Tinley Park, Ill.

[21] Appl. No.: 198,109

[22] Filed: Feb. 17, 1994

[51] Int. Cl.[6] ..... H01R 13/422

[52] U.S. Cl. ..... 439/133; 439/134

[58] Field of Search ..... 439/133, 134, 439/304, 367, 149

[56] References Cited

U.S. PATENT DOCUMENTS

| | | | |
|---|---|---|---|
| 2,844,805 | 7/1958 | Darrell | 439/134 |
| 3,345,600 | 10/1967 | Scherer | 439/134 |
| 3,416,123 | 12/1968 | Husebo | 439/134 |
| 3,422,389 | 1/1969 | Husebo | 439/134 |
| 3,539,968 | 11/1970 | Tunstall et al. | 439/134 |
| 3,781,913 | 12/1973 | Liburdi | 439/134 |
| 4,025,140 | 5/1977 | Matys | 439/134 |
| 5,055,057 | 10/1991 | Boyer | 439/133 |
| 5,176,527 | 1/1993 | Herbert | 439/134 |

*Primary Examiner*—Hien D. Vu

*Attorney, Agent, or Firm*—Mark D. Hilliard; Robert A. McCann

[57] ABSTRACT

An electrical plug lockout device having an integrally formed pin for engaging with a prong of an electrical plug to prevent unauthorized insertion of the plug into an electrical outlet. The plug lockout further includes shielding means for shielding all of the prongs of a plug against inadvertant or unauthorized use.

13 Claims, 4 Drawing Sheets

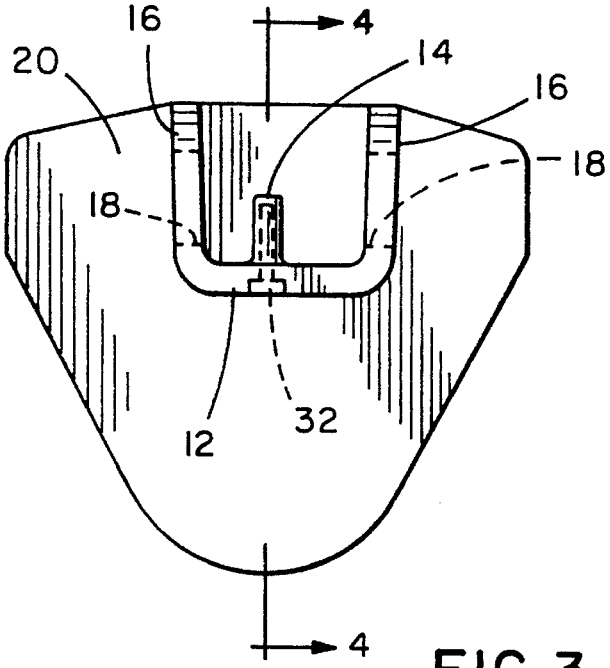
FIG. 3
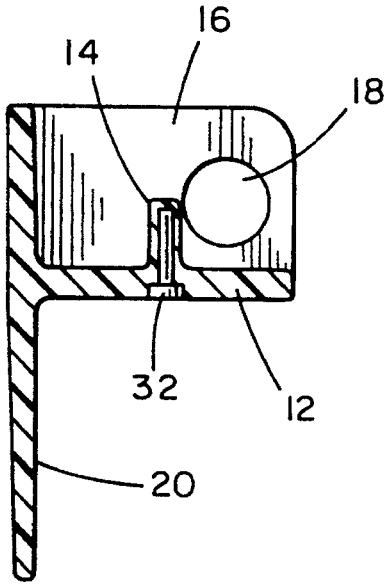
FIG. 4
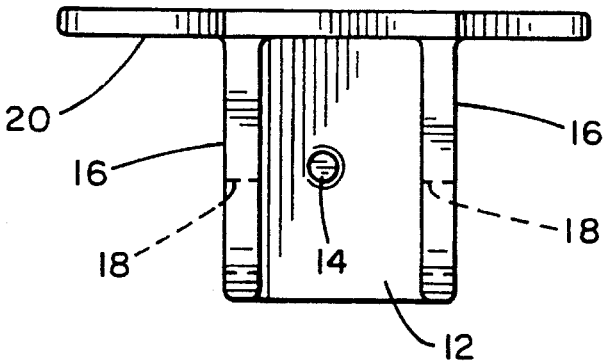
FIG. 5
FIG. 6
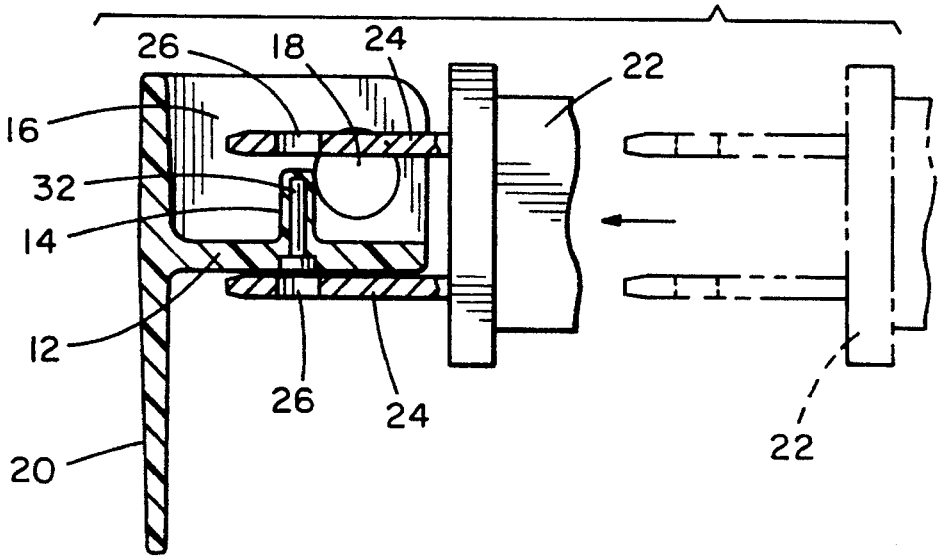

PLUG LOCKOUT

TECHNICAL FIELD

The present invention relates to a plug lockout device, and more particularly to a plug lockout device that attaches to a prong of an electrical plug to prevent the inadvertent or unauthorized insertion of the plug into an electrical outlet.

BACKGROUND OF THE INVENTION

Electrical plug lockouts having various forms are known in the art. Examples of prior lockout devices include U.S. Pat. No. 5,176,527, U.S. Pat. No. 3,539,968 and U.S. Pat. No. 3,416,123. Economy of use and manufacture are important features of devices of this sort. One drawback to the prior art lockout devices is that during use they all require the insertion of a separate pin into holes formed in the lockout device and the prongs in order to engage the electrical plug for lockout purposes. This requires the holding of the lockout device and the plug to align their holes and then requires another hand to insert the locking pin. Therefore, it is advantageous to have a plug lockout device that engages with the electrical plug in a simpler fashion. Furthermore, since many of the standard electrical plugs include a number of prongs, in order to properly protect against undesired insertion of a plug into an electrical outlet, it is important that any and all of the prongs of an electrical plug including any grounding prongs are prevented from being inserted. Thus a plug lockout device that precludes any user from being able to stick any of the prongs into an electrical outlet hole is the most desirable.

SUMMARY OF THE INVENTION

It is therefore an object of the present invention to provide an improved electrical plug lockout.

It is another object of the present invention to provide a plug lockout device that is easily engaged with the electrical plug.

It is also an object of the present invention to provide an electrical plug lockout that fully protects all prongs including any grounding prongs of a plug from inadvertent insertion into an electrical outlet.

The foregoing objects are obtained by a plug lockout device that includes a lockout body member having an integrally formed locking pin, and lock securing means disposed on said body member for locking the body member to a prong of the plug. The plug lockout device further including an integrally formed shield plate and a strengthening pin inserted within the locking pin.

Other objects and advantages of the present invention will become apparent from the following detailed description.

BRIEF DESCRIPTION OF THE DRAWINGS

FIG. 3 is a rear view of the plug lockout of FIG. 1.

FIG. 4 is a sectional side view of the plug lockout shown along lines 4—4 of FIG. 3.

FIG. 5 is a top view of the plug lockout of FIG. 1

FIG. 6 is a sectional side view of the plug lockout of FIG. 1 shown in position to engage a prong of an electrical plug.

DESCRIPTION OF THE PREFERRED EMBODIMENT

Figure 1:
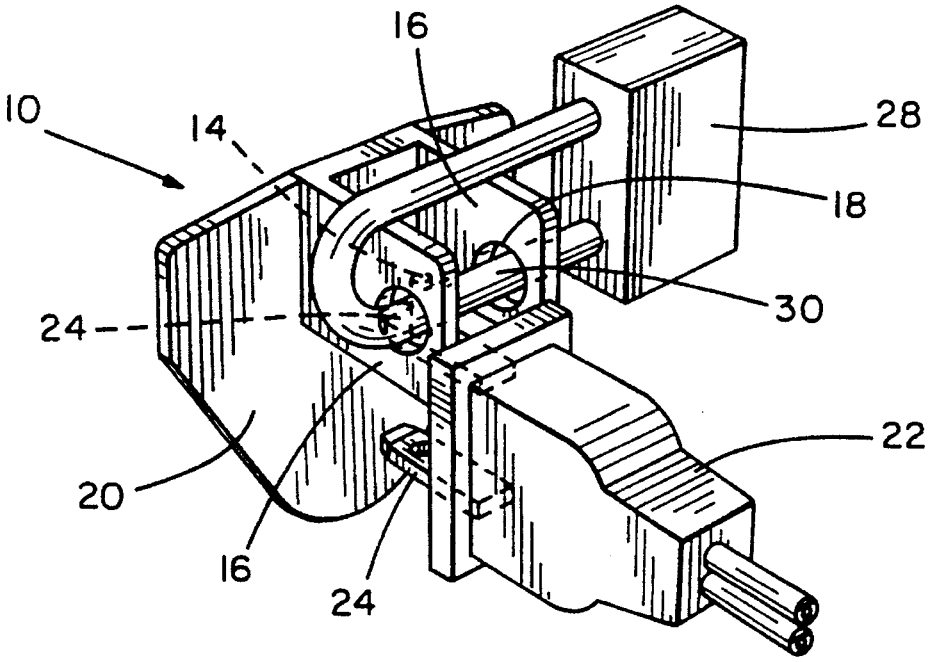
FIG. 1 is a perspective view of a plug lockout embodying the concept of the present invention shown engaged and locked to an electrical plug.

A plug lockout embodying the concept of the present invention is designated generally by the reference numeral 10 in the accompanying drawings. Plug lockout 10 is formed from thermoplastic material that is injection molded into a one-piece lockout device for lockable engagement with a prong 24 of an electrical plug 22 to prevent the unauthorised insertion of plug 22 into an electrical outlet.

As can be seen in FIGS. 3 and 4, lockout 10 generally includes a main body member having a base portion 12 and a pair of integrally formed sidewalls 16 extending perpendicularly from the lateral edges of base 12 so as to be in opposing relation to each other. An integrally formed locking pin 14 is disposed on base 12 and projects vertically in between sidewalls 16 for engaging a hole 26 in prong 24 of plug 22. As can be seen in FIG. 4, locking pin 14 is positioned on base 12 so that it is disposed approximately halfway between a rear shield plate end and an opposite forward end. Locking pin 14 is also positioned slightly offcenter with regard to the width of base 12 as can be seen in FIG. 5. This positioning of locking pin 14 on base 12 allows for a sufficient distance on all sides of locking pin 14 for prongs 24 of most standard electrical plugs, including heavy machinery plugs, 22 to fit within sidewalls 16 and shield plate 20 and be seated on base 12.

In the embodiment shown locking pin 14 is formed having a hollow chamber that has a hardened steel pin 32 press fit into it as a secondary operation that provides additional strength for the locking pin 14.

Figure 2:
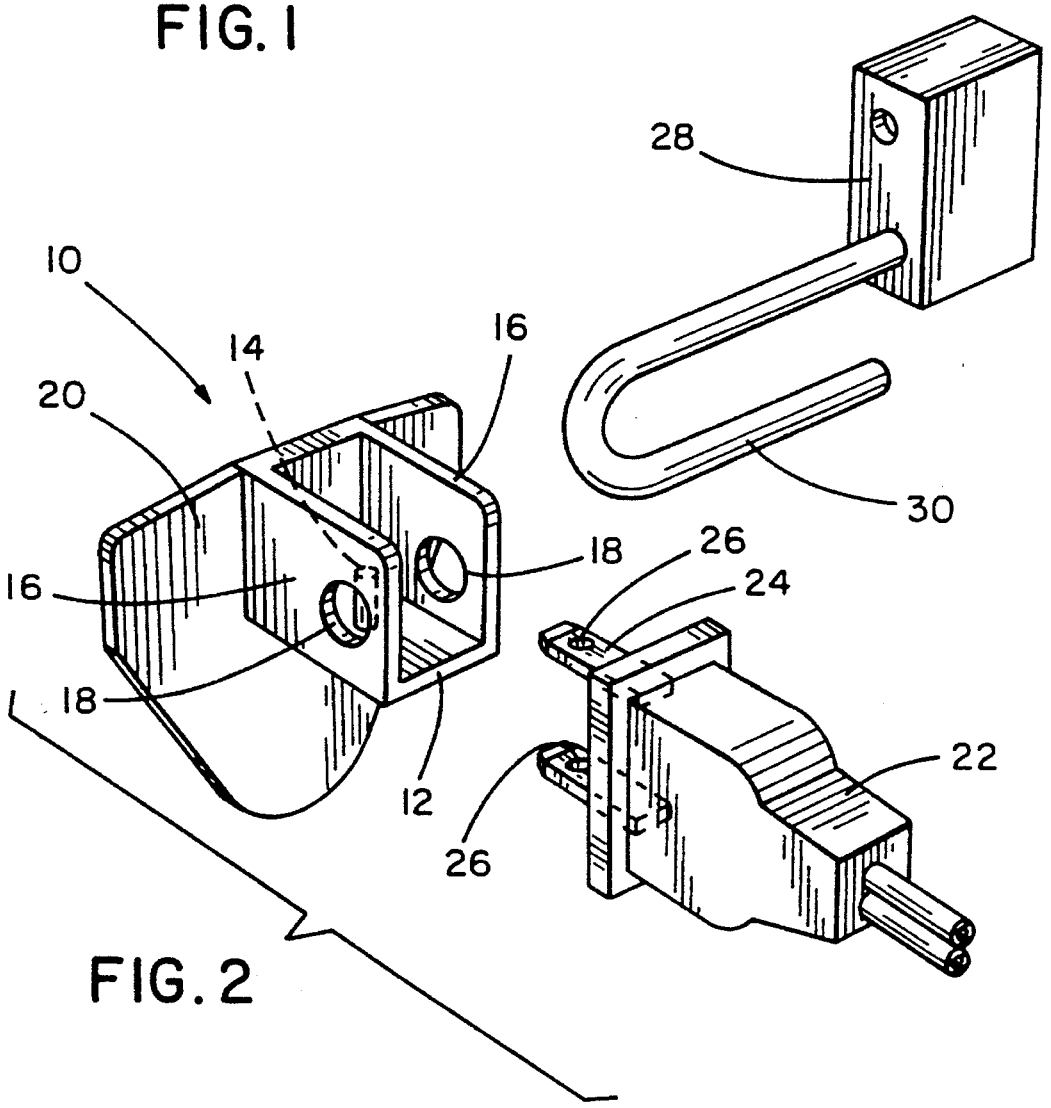
FIG. 2 is an exploded view of the plug lockout device of FIG.1 including an electrical plug and padlock.

As can be seen in FIG. 2, each sidewall 16 includes an aperture 18 formed in its forward end that opposingly aligns with an aperture 18 formed on opposing sidewall 16. Apertures 18 are formed so as to be in a position on sidewalls 16, in between locking pin 14 and the front edge of base 12.

There is further provided a shield plate 20 formed integrally to a rear end of base 12 and sidewalls 16. Shield plate 20 is formed sufficiently large and having a shape that allows it to cover all of the prongs of standard electrical plugs, including any grounding prongs in order to protect them from unauthorised insertion into an electrical outlet. Shield plate 20 has been shown here as having a rounded triangular shape. It could however be formed having any number of shapes. It is only important for proper use that the shield plate 20 be of sufficient size and shape to be able to cover any and all of the prongs 24 of the plug 22 that is to be locked out from use.

As best seen in FIG. 3, shield plate 20 in the embodiment shown is slightly off center with respect to the base 12 and sidewalls 16 of the main body member. This is designed to provide the greatest protection for shielding all the prongs 24 including a grounding prong.

Figure 7:
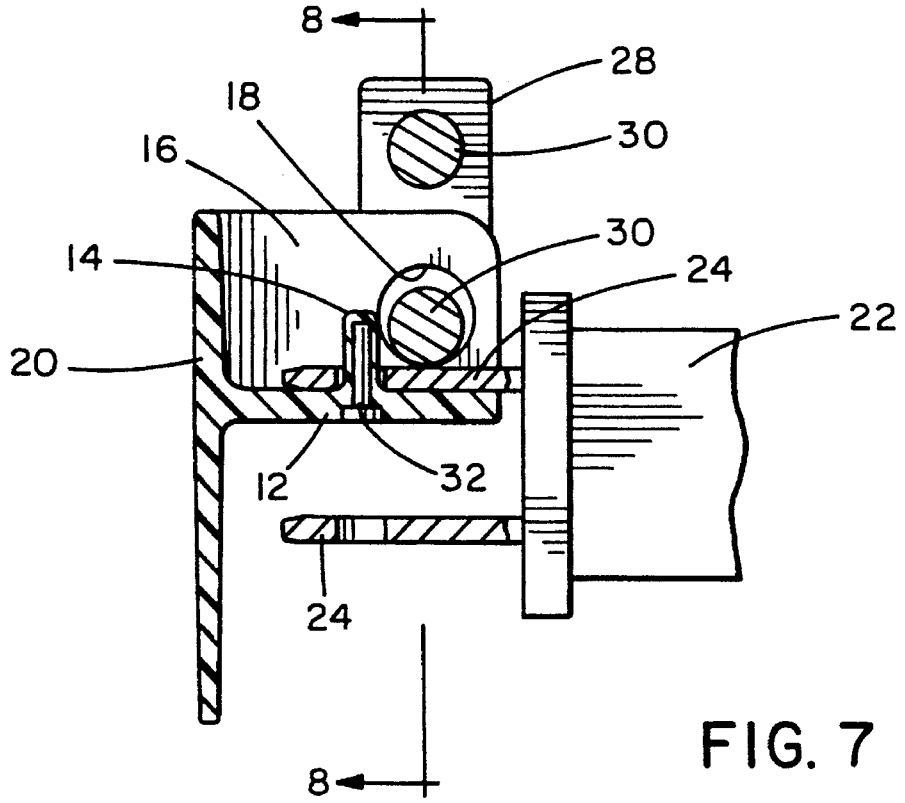
FIG. 7 is a sectional side view of the plug lockout of FIG. 1 secured and locked to an electrical plug.

Use of lockout 10 can best be described with reference to FIGS. 6–8. As can be seen in FIG. 6, plug 22 is brought into position so that hole 26 of prong 24 of plug 22 is aligned with locking pin 14. Locking pin 14 including strengthening pin, is subsequently inserted into and engaged with hole 26 to secure plug 22 to lockout 10. Once in this position, a shackle 30, of a locking device such as a standard padlock 28, is inserted through both holes 18 in sidewalls 16 and is locked. The positioning of apertures 18 on sidewalls in between locking pin 14 and the front part of base 12, causes shackle 30 to prevent the prong 24 from being disengaged from the lockout.

Figure 8:
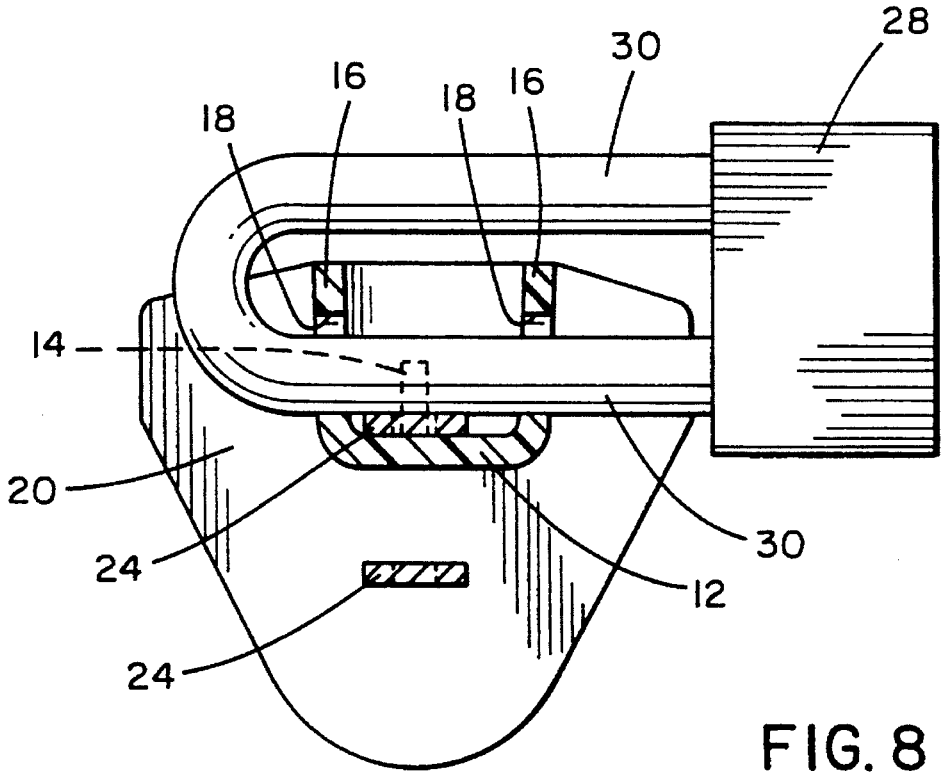
FIG. 8 is a sectional rear view of the plug lockout engaged and locked to an electrical plug shown along lines 8—8 of FIG. 7.
Figure 9:
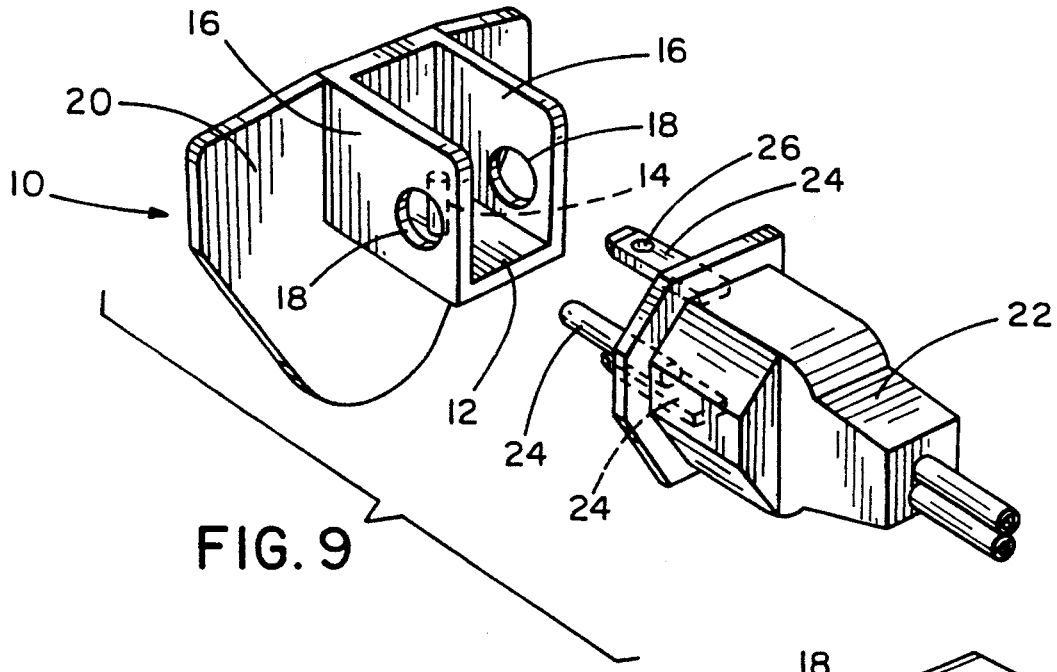
FIG. 9 is an exploded view of the plug lockout device of FIG. 1 and a 3-pronged plug.
Figure 10:
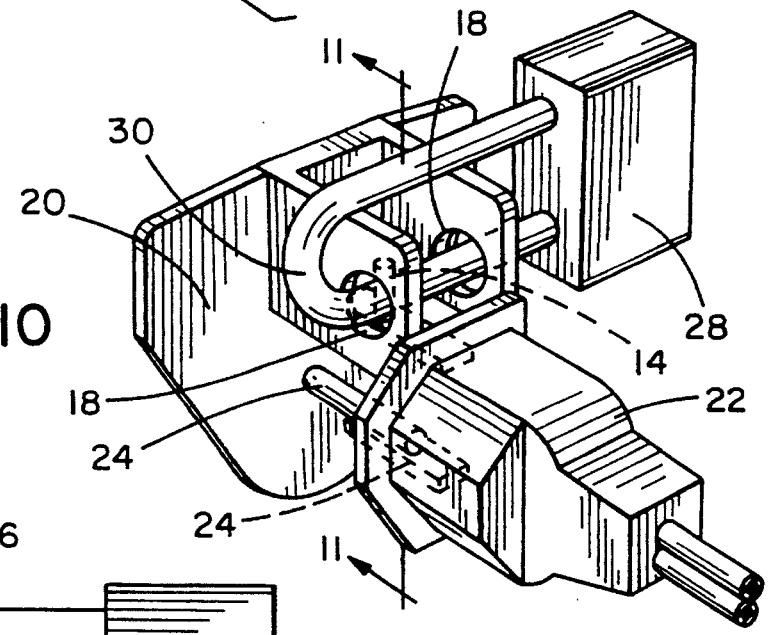
FIG. 10 is a perspective view of the plug lockout of FIG. 1 shown secured and locked to a 3-pronged plug.
Figure 11:
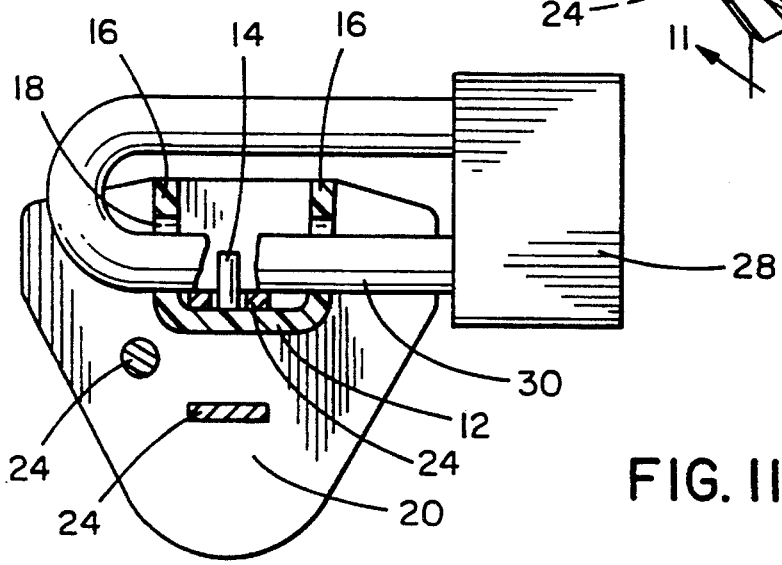
FIG. 11 is a sectional rear view of the plug lockout engaged and locked to a 3-pronged electrical plug shown along lines 11—11 of FIG. 10.

As can be seen in FIGS. 8 and 11, with plug lockout 10 lockably engaged with a prong 24 of plug 22, shield plate 20 covers all the remaining prongs including the grounding prong.

While the particular embodiments of the present invention have been shown and described, it will be obvious to those skilled in this art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical plug lockout device lockably preventing unauthorized insertion of an electrical plug into an electrical outlet, comprising:

a one-piece lockout body member having a base including an integrally formed locking pin and a pair of opposing sidewalls vertically disposed on lateral edges of the base wherein the locking pin extends upwardly from the base and parallel to the sidewalls, and wherein the body member further includes an opening opposite said base; and lock securing means disposed on said body member locking a prong of the plug to the body member.

2. An electrical plug lockout device according to claim 1, wherein each of said pair of sidewalls having an aperture formed opposingly aligned to each other.

3. An electrical plug lockout device in accordance with claim 2, wherein said locking pin further includes a strengthening rod inserted within a cored out portion of the locking pin.

4. An electrical plug lockout device according to claim 2, further including shielding means attached to the body member for shielding all prongs of the plug from being inserted into the electrical outlet.

5. An electrical plug lockout device according to claim 4, wherein the shielding means comprises a shield plate integral to a rear end of the body member.

6. An electrical plug lockout device according to claim 5, wherein each aperture is disposed on each sidewall so as to be positioned in between the locking pin and a forward end of the body member opposite to the rear end.

7. An electrical plug lockout device lockably preventing unauthorized insertion of an electrical plug into an electrical outlet comprising:

a one-piece body member having a front end and a rear end, formed by a base and a pair of opposing sidewalls;

an integrally formed locking pin extending upwardly from the base in between the pair of opposing sidewalls and engaging a prong of the electrical plug; and each of said pair of sidewalls having an opposingly aligned hole positioned between the locking pin and the front end; and wherein said locking pin further includes a cored out section with a strengthening rod inserted within the cored out section of the locking pin.

8. An electrical plug lockout device in accordance with claim 7, further including shielding means integrally formed at the rear end of the base to shield all prongs of the plug.

9. An electrical plug lockout device in accordance with claim 8, wherein the shielding means comprises a shield plate formed to have sufficient size and shape to cover said prongs.

10. An electrical plug lockout device lockably preventing unauthorized insertion of an electrical plug into an electrical outlet, comprising:

a plastic lockout body member having an integrally formed locking pin engaging with an aperture of a prong of the electrical plug, said locking pin extending upwardly from a base, said base having a pair of sidewalls disposed vertically on the base wherein each of said pair of sidewalls includes a hole formed opposingly aligned to each other; wherein the locking pin further includes a strengthening rod inserted within a cored out portion of the locking pin; and lock securing means disposed on said body member and locking the prong of the plug to the body member.

11. An electrical plug lockout device according to claim 10, further including shielding means attached to the body member for shielding all of the prongs of the plug from being inserted into an electrical outlet.

12. An electrical plug lockout device according to claim 11, wherein the shielding means comprises a shield plate integral to a rear end of the body member.

13. An electrical plug lockout device according to claim 12, wherein holes are disposed between the locking pin and a forward end of the body member opposite to the rear end.

* * * * *